US005660875A

United States Patent [19]

Muchi et al.

[11] Patent Number: 5,660,875

[45] Date of Patent: Aug. 26, 1997

[54] METHOD AND APPARATUS FOR USE IN PRODUCING CATHODE RAY TUBE

[75] Inventors: Tsuneo Muchi; Yoji Kono, both of Kanagawa; Kano Shimizu, Tokyo, all of Japan

[73] Assignee: Sony Corporation, Tokyo, Japan

[21] Appl. No.: 408,573

[22] Filed: Mar. 22, 1995

[30] Foreign Application Priority Data

Mar. 23, 1994 [JP] Japan ..... 6-051783

[51] Int. Cl.[6] ..... B05D 5/06

[52] U.S. Cl. ..... 427/64; 427/68; 427/282; 427/385.5

[58] Field of Search ..... 427/64, 68, 282, 427/385.5

[56] References Cited

U.S. PATENT DOCUMENTS 2,827,390 3/1958 Garrigus ..... 427/282

4,531,475 7/1985 Thill ..... 427/282

5,174,201 12/1992 Andris et al. ..... 427/282

5,277,840 1/1994 Osaka ..... 427/64

*Primary Examiner*—Janyce Bell

*Attorney, Agent, or Firm*—Hill, Steadman & Simpson

[57] ABSTRACT

In a method of coating a curved panel in a cathode ray tube, by placing on the inner surface of a panel having a curved surface a screen frame of a boat-shaped configuration across the bottom of which a screen printing screen is stretched; and by moving a squeegee pushed against the surface of the screen so that ink coated on the surface of the screen passes through the screen and prints on the inner surface of the panel, a fluorescent screen having a good and even film is fabricated on the inner surface of the cathode ray tube panel having a curved face, by a screen printing. In the method, electro-conductive terminals for electro-deposition are not required, steps are reduced, production costs are reduced, and production quality is stabilized.

5 Claims, 4 Drawing Sheets

METHOD AND APPARATUS FOR USE IN PRODUCING CATHODE RAY TUBE

BACKGROUND OF THE INVENTION

1. Field of the Invention

The present invention relates to a method and apparatus for use in producing a cathode ray tube, more particularly to a method and apparatus for fabricating a fluorescent screen at the inner surface of a cathode ray tube panel.

2. Description of the Related Art

One well known conventional method of fabricating a fluorescent screen at the inner surface of a cathode ray tube panel is the so-called "slurry method". The slurry method involves coating of a phosphor slurry followed by drying, exposure and development, washing and removal, and other steps. The facilities required therefore become large in size and the work becomes complicated.

Therefore, other methods such as electro-deposition and heat transfer have been proposed.

In the electro-deposition method,.however, the entire surface of the panel is immersed in an electro-deposition tank, so phosphors deposit at portions other than the intended fluorescent screen as well. Removal of this requires washing, wiping, and other work. If phosphors remain at the unnecessary portions, then the unnecessary portions will fluoresce when irradiated by a beam.

Electro-deposition also requires the provision of an electro-conductive film (for example, a metal-back layer such as vapor-deposited aluminum film etc.) as an underlayer at the inside surface of the panel. Further, it requires terminals for the conduction of power at the time of electro-deposition.

Further, the heat transfer method requires a heat transfer film comprised of a base film, a separation layer, a phosphor layer, and an adhesion layer. It also requires a step of heat transfer printing on the inner surface of a curved panel using this heat transfer film. Accordingly, the process is complicated and the manufacturing costs become high. After the heat transfer printing, further, a step of burning off the resin component included in the separation layer and the adhesion layer is required. Therefore, there are a large number of steps and there is a danger of dust and other foreign matter depositing on the fluorescent screen and thereby the quality of the fluorescent screen becoming unstable.

Therefore, attempts have been made to fabricate a fluorescent screen on the inner surface of the panel by screen printing.

The screen used for screen printing, however, as shown in FIGS. 1A and 1B, is a flat-stretched screen 2. The screen frame 3 gets in the way and therefore it is not possible to print on the inner surface of the curved panel. Note that the screen 2 shown in FIGS. 1A and 1B has a transfer pattern 1 formed at its center. By moving a squeegee 4 along the surface of the screen 2, the ink 5 is spread and the pattern 1 is transferred to the work.

SUMMARY OF THE INVENTION

An object of the present invention is to provide a method and apparatus for fabricating a fluorescent screen of a cathode ray tube which does not require electro-conductive terminals for electro-deposition, requires fewer number of steps, and enables a reduction of manufacturing costs and stabilization of quality by fabricating a fluorescent screen of a uniform, good quality on the inner surface of a cathode ray tube panel having a depressed curved surface by screen printing.

To achieve the above object, according to a first aspect of the present invention, there is provided a method of fabricating a fluorescent screen of a cathode ray tube including a step of placing on the inner surface of a panel having a curved surface a screen frame of a boat-shaped configuration across the bottom of which a screen printing screen is stretched and a step of moving a squeegee while pushing against the surface of the screen so that ink coated on the surface of the screen passes through the screen and prints on the inner surface of the panel.

According to a second aspect of the present invention, there is provided an apparatus for fabricating a fluorescent screen of a cathode ray tube comprising a slide table on which a panel is set so that its inner surface faces upward, a screen frame of a boat-shaped configuration across the bottom of which a screen printing screen is stretched and provided with a recess of a predetermined depth, a screen frame setting means for setting the screen frame so that the screen of the screen frame is disposed at a predetermined clearance from the inner surface of the panel, and a squeegee movement means for causing a squeegee inserted in the recess to move while pressing against the surface of the screen so that ink coated on the surface of the screen passes through the screen to print on the inner surface of the panel. Note that "on which a panel is set so that its inner surface faces upward" means that the panel is set so that its inner surface faces upward with respect to the side where the screen frame is set. This is not necessarily limited to upward in the vertical direction.

The thickness of the screen frame differs depending on the size and type of the cathode ray tube, but in the case of a 4-inch cathode ray tube is preferably 0.5 to 2.0 mm. In the case of a 10-inch tube, it is preferably 1.0 to 3.0 mm or so and in the case of a 15-inch tube preferably 4 to 10 mm or so. Further, the depth of the recess of the screen frame is preferably set to an extent whereby the screen frame protrudes from a skirt portion of the panel when the screen is set at the inner surface of the panel.

The radius of curvature of the bottom of the screen frame across which the screen is stretched is preferably within the range of 80 to 120 percent of the radius of curvature of the inner surface of the panel, more preferably 100 to 110 percent of the same.

When using the apparatus for fabricating a fluorescent screen of a cathode ray tube according to the present invention to fabricate a fluorescent screen on the inner surface of a panel, first the panel is placed on the slide table so that the inner surface faces upward. Next, the slide table is moved to set the panel at a fixed position.

After this, the screen frame is set above the panel so that the screen of the screen frame is positioned at a predetermined clearance from the inner surface of the panel. The inking means etc. are then inserted into the boat-shaped recess of the screen frame and the inking means is made to move along the surface of the screen to coat the fluorescent screen fabrication ink on the surface of the screen.

Next, a squeegee is inserted into the boat-shaped recess of the screen frame and its front end is made to move while pressing the surface of the screen so as to cause the fluorescent screen fabricating ink to pass through the screen and print on the inner surface of the panel, thereby fabricating the fluorescent screen on the inner surface of the panel.

Next, the squeegee is made to retract from the boat-shaped recess of the screen frame and the panel with the fluorescent screen formed on it is taken out from the slide table.

By fabricating the fluorescent screen of the cathode ray tube using the apparatus for fabricating a fluorescent screen of a cathode ray tube according to the present invention, it is possible to fabricate a fluorescent screen with uniform, good film quality on the inner surface of a cathode ray tube panel having a recessed curved surface by screen printing.

Further, according to the method for fabricating a fluorescent screen of a cathode ray tube according to the present invention, since the fluorescent screen is fabricated by screen printing, there is no need for forming electrodeposition terminals etc. on the inner surface of the panel and the outer appearance is improved as well. In addition, with the method of the present invention, there is no need for a washing step etc., so the number of steps can be cut compared with other methods and therefore the manufacturing costs can be reduced and the quality can be stabilized.

BRIEF DESCRIPTION OF THE DRAWINGS

The above objects and features of the present invention will be more apparent from the following description of the preferred embodiments with reference to the accompanying drawings, wherein.

DESCRIPTION OF THE PREFERRED EMBODIMENTS

Preferred embodiments of the present invention will be described next with reference to the figures.

Figure 1A:
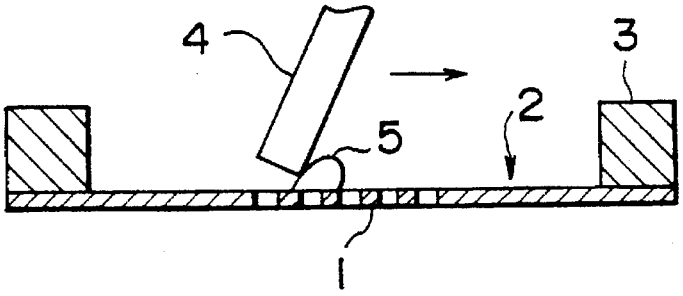
FIG. 1A (RELATED ART)
FIGS. 1A and 1B are a cross-sectional view and perspective view of an example of screen printing according to the related art.
Figure 1B:
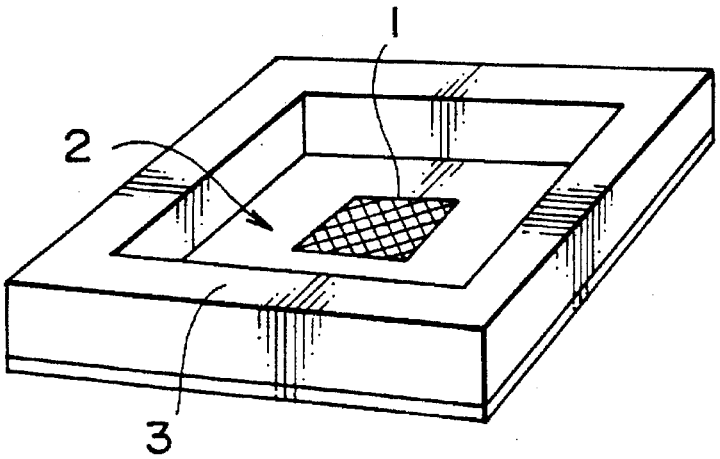
FIG. 1B (RELATED ART)
Figure 2:
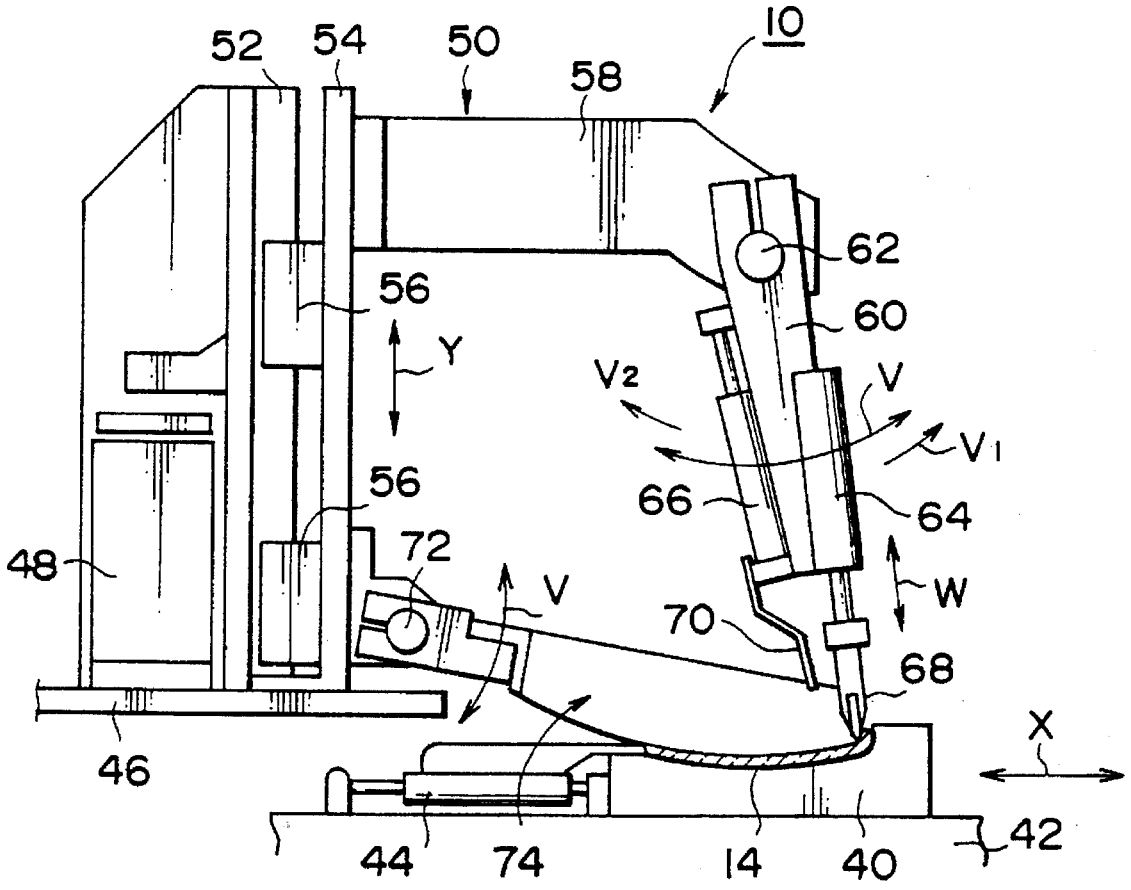
FIG. 2 is a schematic side view of an apparatus for fabricating a fluorescent screen of a cathode ray tube according to an embodiment of the present invention.
Figure 3:
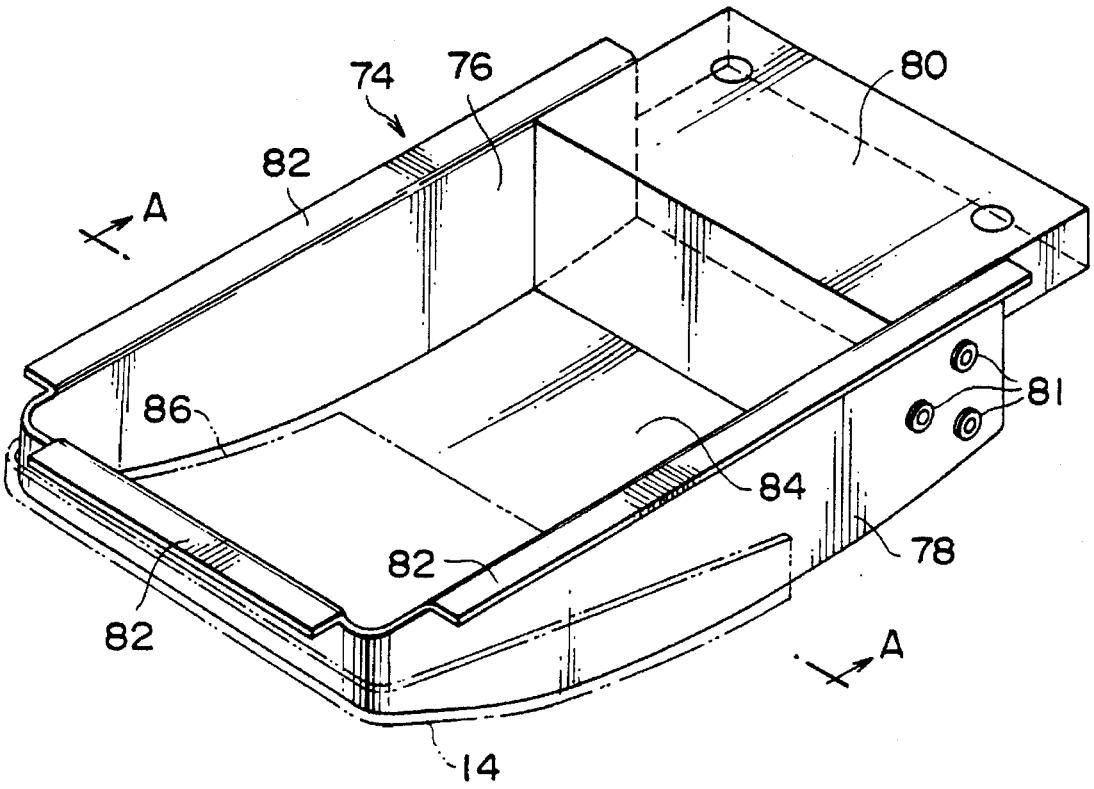
FIG. 3 is a perspective view of the screen frame shown in FIG. 2.
Figure 4:
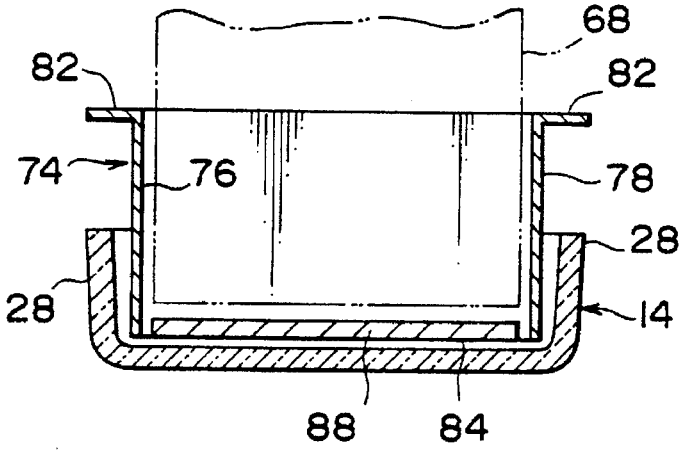
FIG. 4 is a cross-sectional view along line A—A in FIG. 3.
Figure 6:
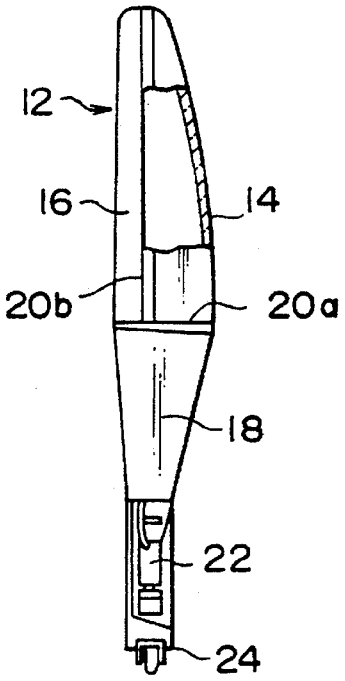
FIG. 6 is a schematic view of a flat type cathode ray tube.

The fluorescent screen fabrication apparatus 10 shown in FIGS. 2 to 4 is used for forming a fluorescent screen on the inner surface of a fluorescent screen forming panel 14 of a flat type cathode ray tube 12 shown in FIG. 6, for example, by the screen printing method.

First, an explanation will be made of a flat type cathode ray tube 12.

As shown in FIG. 6, the flat type cathode ray tube 12 is comprised of a fluorescent screen forming panel 14, a front panel 16, and a funnel 18. These are joined by frit glass connecting portions 20*a* and 20*b*.

At the rear end of the funnel 18 is housed an electron gun 22. The funnel 18 is sealed at the stem neck 24 so that the inside of the cathode ray tube becomes a high vacuum.

Figure 5A:
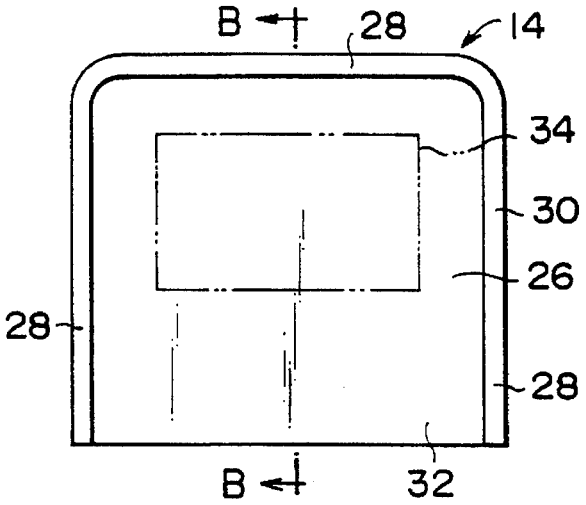
FIG. 5A is a front view of the inner side of the panel.
Figure 5B:
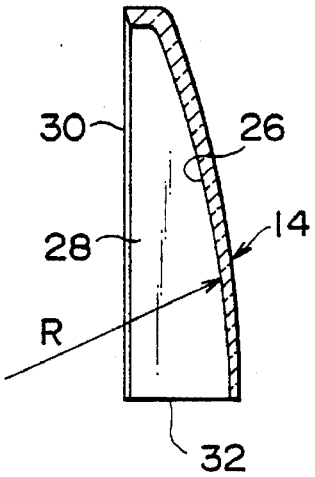
FIG. 5B is a cross-sectional view taken along line B—B of FIG. 5A.
Figure 5C:
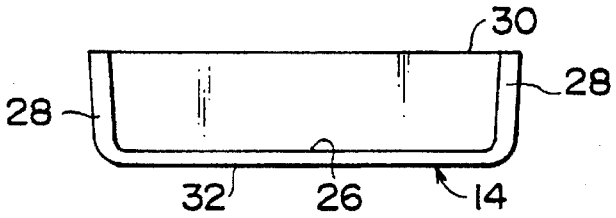
FIG. 5C is a bottom view of the panel.

The fluorescent screen forming panel 14 of the flat type cathode ray tube 12, as shown in FIGS. 5A to 5C, has an inner surface 26 with a predetermined radius of curvature, for example, a radius of curvature of 200 mm, and a skirt portion 28 formed at three edges. The top surface 30 of the skirt portion 28 of the panel 14 is connected to the front panel 16 by the frit glass connecting portion 20*b* shown in FIG. 6. Further, the bottom surface 32 of the panel 14 is connected to the funnel 18 by the frit glass connecting portion 20*a* shown in FIG. 6.

To form a fluorescent screen 34 by the screen printing method over a predetermined range of the inner surface 26 with this radius of curvature, use is made of the fluorescent screen fabrication apparatus 10 according to the present embodiment shown in FIGS. 2 to 4.

As shown in FIG. 2, the fluorescent screen fabrication apparatus 10 has a slide table 40 on which the panel 14 on which the fluorescent screen is to be fabricated is positioned so that its inner surface faces upward. The slide table 40 is slidably attached on a support 42 in the direction of the arrow X by an air driven cylinder or other actuator 44 etc.

A printing block mounting plate 46 is positioned above the support 42. Above the printing block mounting plate 46 is attached the air driven cylinder or other actuator 48. A printing block 50 can therefore be moved vertically along a linear guide 52. The printing block 50 is attached to be movable in the vertical direction Y with respect to the linear guide 52 via a linear bearing 56 attached to a mounting base 54.

Above the mounting base 54 of the printing block 50 is affixed the base end of an affixing arm 58. At the front end of the affixing arm 58 is attached a swing arm 60 in a manner swingable in the direction of the arrow V about the pivot shaft 62. At the front end of the swing arm 60 are attached a squeegee actuator 64 and an inking actuator 66. These actuators 64 and 66 are for example comprised of air driven cylinders.

At the front end of the squeegee actuator 64 is attached a squeegee 68. The actuator 64 is used to control this to advance or retract in the longitudinal direction W of the swing arm 60. At the front end of the inking actuator 66 is attached a squeegee 70. The actuator 66 is used to control this to advance and retract along the longitudinal direction W of the swing arm 60.

Note that the radius of the swing of the swing arm 60, that is, the distance from the pivot shaft 62 to the front end of the squeegee 68 at the time of printing, is set so as to substantially match the radius of curvature of the inner surface of the panel 14. Further, as the means for causing the swing arm 60 to swing (squeegee movement means), use may be made of an air-driven cylinder, a hydraulic cylinder, an electrically powered motor actuator, etc.

Below the mounting base 54 of the printing block 50 is attached a screen frame 74 in a manner pivotable about a pivot shaft 79. The screen frame 74, as shown in FIG. 3, has a boat-shaped configuration with a boat-shaped recess 76 of a predetermined depth and is comprised of a frame body 78 and a frame support block 80. The frame support block 80, as shown in FIG. 2, is connected to the pivot shaft 72 through a connecting member or directly. The frame support block 80 and the frame body 78 are connected for example by bolts. Note that to improve the strength of the screen frame 74, provision may be made of frame support columns at parts of the boat-shaped recess 76 other than the printing surface.

The frame body 78 is comprised of a metal sheet material or rigid plastic sheet material (preferably metal sheet) of a thickness of 0.5 to 2.0 mm, preferably about 1.0 mm, for example. At the top is formed a flange portion 82. The bottom of the frame body 78 has a radius of curvature corresponding to the radius of curvature of the inner surface of the panel 14 which is to be screen printed. The radius of curvature of the frame body 78 is preferably 0.8 to 1.2×R, more preferably 1.0 to 1.1×R, where R is the radius of curvature of the inner surface of the panel 1 (see FIG. 5B). More specifically, when the radius of curvature R of the inner surface of the panel 14 is 200 mm, the radius of curvature of the bottom of the frame body 78 is preferably 150 to 210 mm, more preferably 200 to 210 mm.

Across the bottom of the screen frame 74 comprised of the frame body 78 with this radius of curvature and the support block 80, as shown in FIG. 4, is stretched a screen 84. The screen 84 has formed on it a printing surface 86 of a predetermined pattern before being stretched over the bottom of the screen frame 74. The printing surface 86 is formed by coating an emulsion comprised of a photocuring resin etc. on the surface of the screen material stretched across a flat frame and exposing and washing the same. The screen 84 with the printing surface 86 formed on it is then restretched over the bottom of the screen frame 74.

In this embodiment, the screen frame 74 has a boat-shaped configuration, so it is possible to form the printing surface 86 on the screen 84 (see FIG. 3) right up close to the frame body 78.

As shown in FIG. 4, the fluorescent screen forming ink 88 is then coated on the surface of the screen positioned at the bottom of the boat-shaped recess 76.

The depth of the boat-shaped recess 76 formed in the screen frame 74, as shown in FIGS. 3 and 4, is set to an extent so that the screen frame 74 protrudes slightly from the skirt portion 28 of the panel 14 when the screen frame 74 is set at the inner surface of the panel 14.

The screen frame 74 is arranged at a predetermined clearance from the inner surface of the panel, as shown in FIG. 2, by a screen frame setting means. The screen frame setting means, in the embodiment shown in FIG. 2, is comprised of an actuator 48 for adjusting the vertical movement of the mounting base 54 and an actuator (not shown) for adjusting the pivoting of the screen frame about the pivot shaft 72.

Next, an explanation will be made of a second embodiment of the present invention. That is, an explanation will be made of a method for fabricating a fluorescent screen on an inner surface of the panel using the apparatus 10 for fabricating a fluorescent screen shown in FIGS. 2 to 4.

First, before forming the fluorescent screen 34, an underlayer is formed on the inner surface of the panel shown in FIG. 5. There are for example four methods for forming the underlayer. The first method is to form a metal-back layer comprised of a vapor-deposited aluminum film etc. at a region slightly larger than the fluorescent screen. The second method is to form a metal-back layer comprised of a vapor-deposited aluminum film etc. at substantially the entire inner surface of the panel 14. The third method is to form a carbon film of a predetermined pattern over substantially the entire inner surface of the panel 14 by printing etc. The fourth method is to form a transparent electro-conductive film over substantially the entire inner surface of the panel 14. In the first method, it is necessary to form a transparent electro-conductive film at the bottom 32 of the inner surface of the panel 14 (see FIG. 5) so as to connect to just the metal-back layer after fabricating the fluorescent screen 34 by the later mentioned method. After the underlayer is formed by any of the above methods, a fluorescent screen 34 is fabricated on the inner surface of the panel 14 by the following method.

First, as shown in FIG. 2, the panel 14 is placed on the slide table 40 so that the inner surface faces upward. When placing the panel 14 on the slide table 40, the slide table 40 is made to move in the direction of the arrow X by the actuator 44 to stand by at the panel set position.

Next, the slide table 40 is moved in the direction of the arrow X by driving the actuator 44 so as to set the panel at a fixed position in preparation for printing.

Next, the actuator 48 is driven to move the printing block 50 downward along the direction of the arrow Y and set the screen frame 74 above the panel 14 so that the screen of the screen frame 74 is positioned at a predetermined clearance from the inner surface of the panel 14. The above-mentioned predetermined clearance is not particularly limited, but for example is preferably 0.5 to 2.0 mm.

Next, first the actuator 55 is driven to insert the inking means 70 in the boat-shaped recess of the screen frame 74. In that state, the swing arm 60 is rocked in the direction of the arrow $V_1$ to make the inking means 70 move along the surface of the screen 84 and thereby coat the fluorescent screen fabrication ink 88 on the surface of the screen 84. The fluorescent screen fabrication ink is supplied to the surface of the screen 84 at the side opposite to the frame support block 80 positioned in the boat-shaped recess 76 of the screen frame 74.

After the ink is coated on the surface of the screen 84, in particular the printing surface 86, by the inking means 70, the actuator 66 is driven to pull up the inking means 70. At the same time as this or after this, the actuator 64 is driven to insert the squeegee 68 in the boat-shaped recess 76 of the screen frame 74 and push the front end against the surface of the screen 84. In this state, the swing arm 60 is made to move in the direction of the arrow $V_2$ to cause the fluorescent screen fabrication ink to pass through the printing surface 86 of the screen 84 and print on the inner surface of the panel 14, thereby fabricating the fluorescent screen 34 on the inner surface of the panel 14. That is, by one reciprocal swinging motion of the swing arm 60, a fluorescent screen is formed on the inner surface of the panel 14. At this time, ink is present at the frame support block 80 side.

Next, the actuator 64 is driven to cause the squeegee 68 to retract from the boat-shaped recess 76 of the screen frame 74. Further, the actuator 48 is driven to pull up the printing block 50 along the direction of the arrow Y. Next, the actuator 44 is driven to move the slide table 40 along the direction of the arrow X to the panel extraction position and the panel 14 with the fluorescent screen formed on it is taken out from the slide table 40.

By fabricating the fluorescent screen of the cathode ray tube using the apparatus 10 for fabricating a fluorescent screen of a cathode ray tube according to this embodiment, it is possible to fabricate a fluorescent screen 34 with a uniform, good film quality on the inner surface of a cathode ray tube panel 14 having a recessed curved surface as shown in FIG. 5 by screen printing.

Further, according to the method for fabricating a fluorescent screen of a cathode ray tube according to this embodiment, since the fluorescent screen 34 is fabricated by screen printing, there is no need for forming electro-deposition terminals etc. on the inner surface of the panel 14 and the outer appearance is improved as well. In addition, with the method of the present invention, there is no need for a washing step etc., so the number of steps can be cut compared with other methods and therefore the manufacturing costs can be reduced and the quality can be stabilized.

While the invention has been described by reference to the specific embodiments chosen for purposes of illustration, it should be apparent that numerous modifications could be made thereto by those skilled in the art without departing from the basic concept and scope of the invention.

For example, in the above embodiments, use was made of the method and apparatus for fabricating a fluorescent screen of the present invention to fabricate a monochrome fluorescent screen on the inner surface of the panel of a monochrome flat-type cathode ray tube, but they may also be used for fabricating a fluorescent screen on a normal monochrome cathode ray tube or a color flat-type or normal cathode ray tube. When fabricating a fluorescent screen on the inner surface of a color cathode ray tube panel, the above-mentioned apparatus is used for screen printing for each of the three primary colors.

As explained above, by fabricating a fluorescent screen of a cathode ray tube using the apparatus for fabricating a fluorescent screen of a cathode ray tube according to the present invention, it is possible to fabricate a fluorescent screen with a uniform, good film quality on the inner surface of a cathode ray tube panel having a recessed curved surface by screen printing.

Further, according to the method for fabricating a fluorescent screen of a cathode ray tube according to the present invention, since the fluorescent screen is fabricated by screen printing, there is no need for forming electrodeposition terminals etc. on the inner surface of the panel and the outer appearance is improved as well. In addition, with the method of the present invention, there is no need for a washing step etc., so the number of steps can be cut compared with other methods and therefore the manufacturing costs can be reduced and the quality can be stabilized.

What is claimed is:

1. A method of coating a curved panel with ink including the steps of:

placing, on the inner curved surface of a panel, a screen frame having a curved screen-printing screen stretched across a bottom thereof; and placing ink on an inside surface of said screen;

moving a squeegee pushed against said inside surface of the screen so that ink coated on said inside surface of said screen passes through said screen and prints on said inner curved surface of said panel.

2. A method of coating a curved panel as set forth in claim 1, wherein the radius of curvature of the bottom of said screen frame across which said screen is stretched is within the range of 80 to 120 percent of the radius of curvature of said inner surface of said panel.

3. A method of coating a curved panel which fluorescent screen fabrication ink including the steps of:

placing the curved panel onto a holder with a concave side faced upwardly;

lowering a screen frame having a curved screen-printing screen stretched on a bottom side thereof into said curved panel adjacent a curved surface thereof;

inserting an inking means having a supply of fluorescent screen fabrication ink, into the screen frame and moving said inking means along a surface of the screen to coat fluorescent screen fabrication ink on a surface of the screen;

inserting a squeegee into the screen frame and against the surface of the screen;

moving the squeegee along the surface of the screen, causing the fluorescent screen fabrication ink to pass through the surface of the screen and to print on the curved surface of the panel.

4. A method according to claim 3, wherein said step of moving said inking means is further defined as rotating and extending said inking means from a point above the surface of the screen to follow closely the surface of the screen.

5. A method according to claim 3, wherein said step of moving said squeegee is further defined as rotating and extending said squeegee from a point above the surface of the screen to follow closely the surface of the screen.

* * * * *